US006343957B1

(12) United States Patent
Kuo et al.

(10) Patent No.: US 6,343,957 B1
(45) Date of Patent: Feb. 5, 2002

(54) ELECTRICAL ADAPTER

(75) Inventors: Yu-Jen Kuo; Chin-Pao Kuo, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/852,407

(22) Filed: May 9, 2001

(30) Foreign Application Priority Data

Sep. 29, 2000 (TW) ..... 89216958

(51) Int. Cl.[7] ..... H01R 25/00

(52) U.S. Cl. ..... 439/638; 439/362; 439/76.1; 439/654

(58) Field of Search ..... 439/638, 76.1, 439/359, 362, 607, 654

(56) References Cited

U.S. PATENT DOCUMENTS 4,236,779 A * 12/1980 Tang ..... 439/638
4,398,780 A * 8/1983 Novotny et al. ..... 439/362
5,859,766 A * 1/1999 Van Scyoc et al. ..... 439/362
6,176,743 B1 * 1/2001 Kuo ..... 439/638

* cited by examiner

*Primary Examiner*—Tho D. Ta
(74) *Attorney, Agent, or Firm*—Wei Te Chung

(57) ABSTRACT

A DVI electrical adapter (2) for electrically connecting a monitor to a host computer having different interfaces includes a combined digital & analog receptacle connector (21), a digital-only plug connector (22), two printed circuit boards (PCBs) (23) joined between the plug connector and the receptacle connector, an insulative housing (20) insert molded over a center of the DVI adapter and a pair of elongated fasteners (24). The elongated fasteners project through two sides of the insulative housing and include a first fixing end (241) and a second fixing end (243). The second fixing end engages with nuts of a complementary receptacle connector mounted on the host computer. The first fixing end has a threaded recess accepting screws from a cable plug connector attached to the monitor. The DVI electrical adapter has a smaller size and simpler structure, and is simpler to use than prior art DVI connector.

5 Claims, 6 Drawing Sheets

ELECTRICAL ADAPTER

BACKGROUND OF THE INVENTION

1. Field of the Invention

The present invention relates to an electrical adapter, and particularly to a Digital Visual Interface (DVI) electrical adapter which can be used for electrically connecting together two different types of DVI electrical connectors.

2. Description of the Prior Art

The Digital Visual Interface (DVI) specification is a recently developed monitor interface specification for the PC industry. It provides specification for connectors used to connecting a monitor to a host computer. DVI technology has many advantages over conventional technology, such as video graphics array (VGA) technology. The DVI of specification covers both digital-only connector and combined digital & analog connector. An adapter is required to connect a monitor to a host computer when the monitor and the host computer have different DVI connectors.

Referring to FIG. 6, a conventional DVI electrical adapter 1 includes an insulative housing 10, a digital-only plug connector 11 and a combined digital & analog receptacle connector 12. The digital-only plug connector 11 comprises a pair of screws 13 for fixing to nuts of a complementary receptacle connector mounted in a host computer (not shown), thereby ensuring a firm and reliably connection between the digital-only plug connector 11 and the complementary receptacle connector. The combined digital & analog receptacle connector 12 comprises a pair of nuts 14 for engaging with a pair of screws in a complementary plug connector of a cable assembly connecting to a monitor (not shown) for establishing firm and reliable connection therebetween.

However, since the screws 13 and the nuts 14 of the conventional DVI electrical adapter 1 are separate from each other, a pair of lateral recesses is required in the housing to accommodate heads of the pair of screws so that the screws can be rotated to threadedly engage the nuts of the complementary receptacle connector. This arrangement requires the conventional adapter to be long and bulky which is disadvantageous in view of the minimization trend in computer technology. Furthermore, the adapter 1 requires two separate screws 13 and two separate nuts 14. This is disadvantageous from the standpoints of the increased cost of the components, increased inventory requirement and added assembly cost.

Hence, an improved DVI electrical adapter is desired to overcome the disadvantages of the prior art adapter.

SUMMARY OF THE INVENTION

An object of the present invention is to provide a DVI electrical adapter which can be used for electrically connecting two different types of electrical connectors, the adapter having a compact configuration.

A DVI electrical adapter in accordance with the present invention comprises a digital-only plug connector, a combined digital & analog receptacle connector, a printed circuit boards (PCBs) joined between the plug connector and the receptacle connector, an insulative housing insert molded over a center of the DVI adapter and a pair of elongated fasteners. The digital-only plug connector can connect a second complementary receptacle connector in a host computer and the combined digital & analog receptacle connector can connect a first complementary plug connector to a monitor. The elongated fasteners are projecting through two sides of the insulative housing and include a first fixing end and a second fixing end. The second fixing end engages with nuts of a complementary receptacle connector mounted on the host computer. The first fixing end has a threaded recess accepting screws from a cable plug connector attached to the monitor. When the first fixing end moves, it can bring the second fixing end move synchronously so that fixes the elongated fasteners reliably when the second fixing end engages with nuts of a complementary receptacle connector mounted on the host computer.

Other objects, advantages and novel features of the invention will become more apparent from the following detailed description of the present embodiment when taken in conjunction with the accompanying drawings.

DETAILED DESCRIPTION OF THE INVENTION

Figure 1:
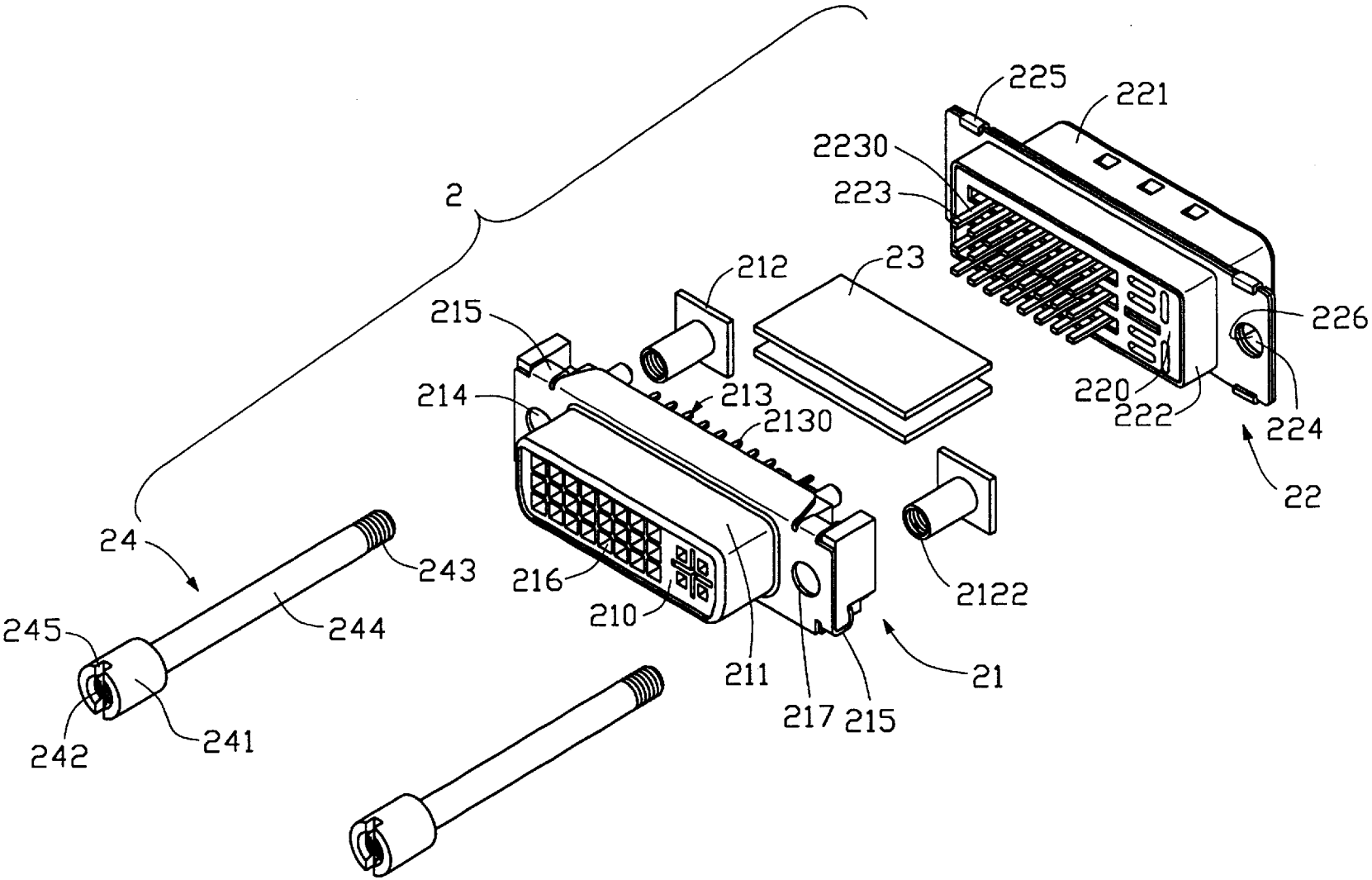
FIG. 1 is an exploded perspective view of a DVI electrical adapter in accordance with the present invention, wherein an insulative housing thereof is not shown.
Figure 2:
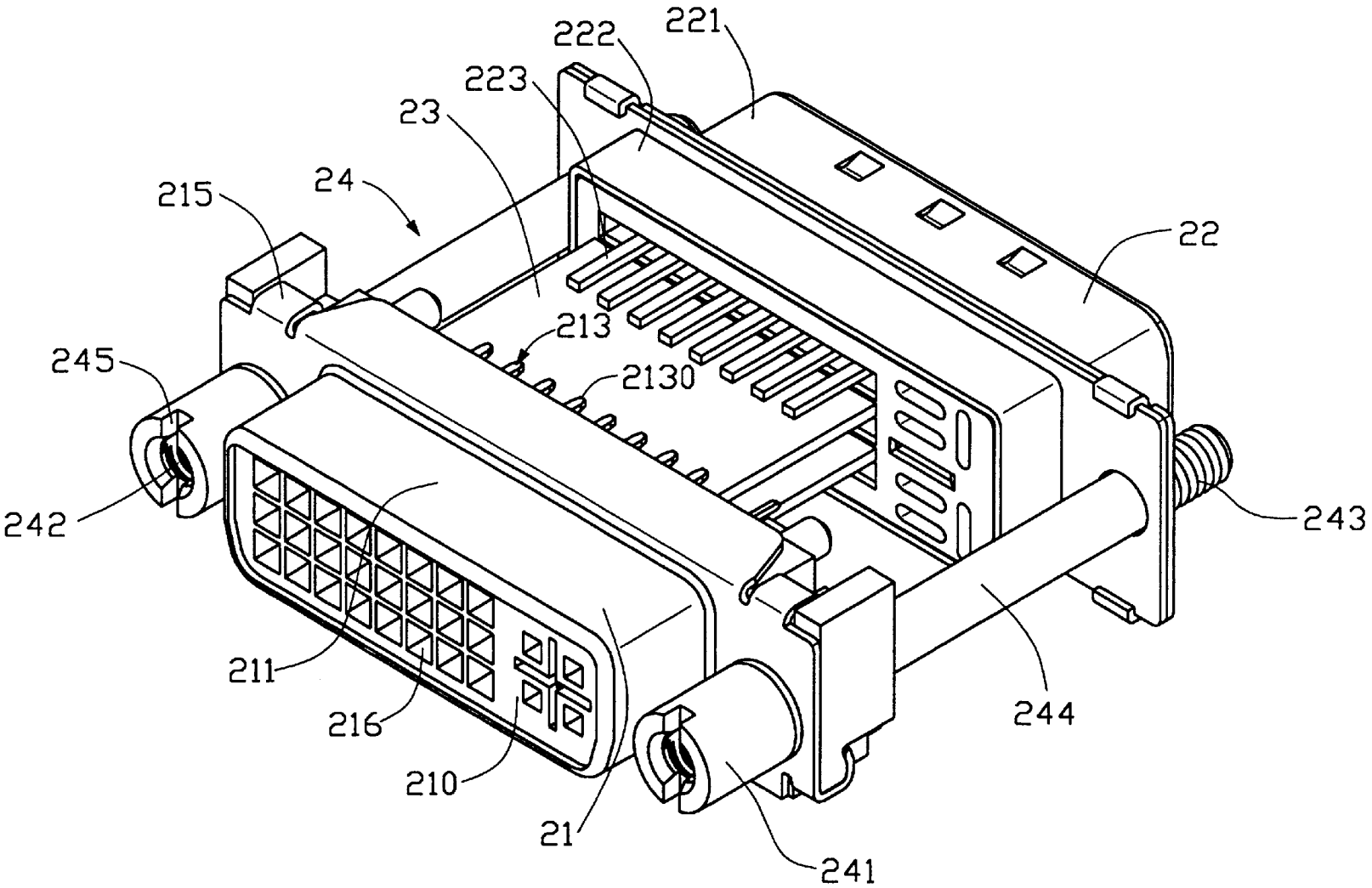
FIG. 2 is an assembled perspective view of FIG. 1.
Figure 3:
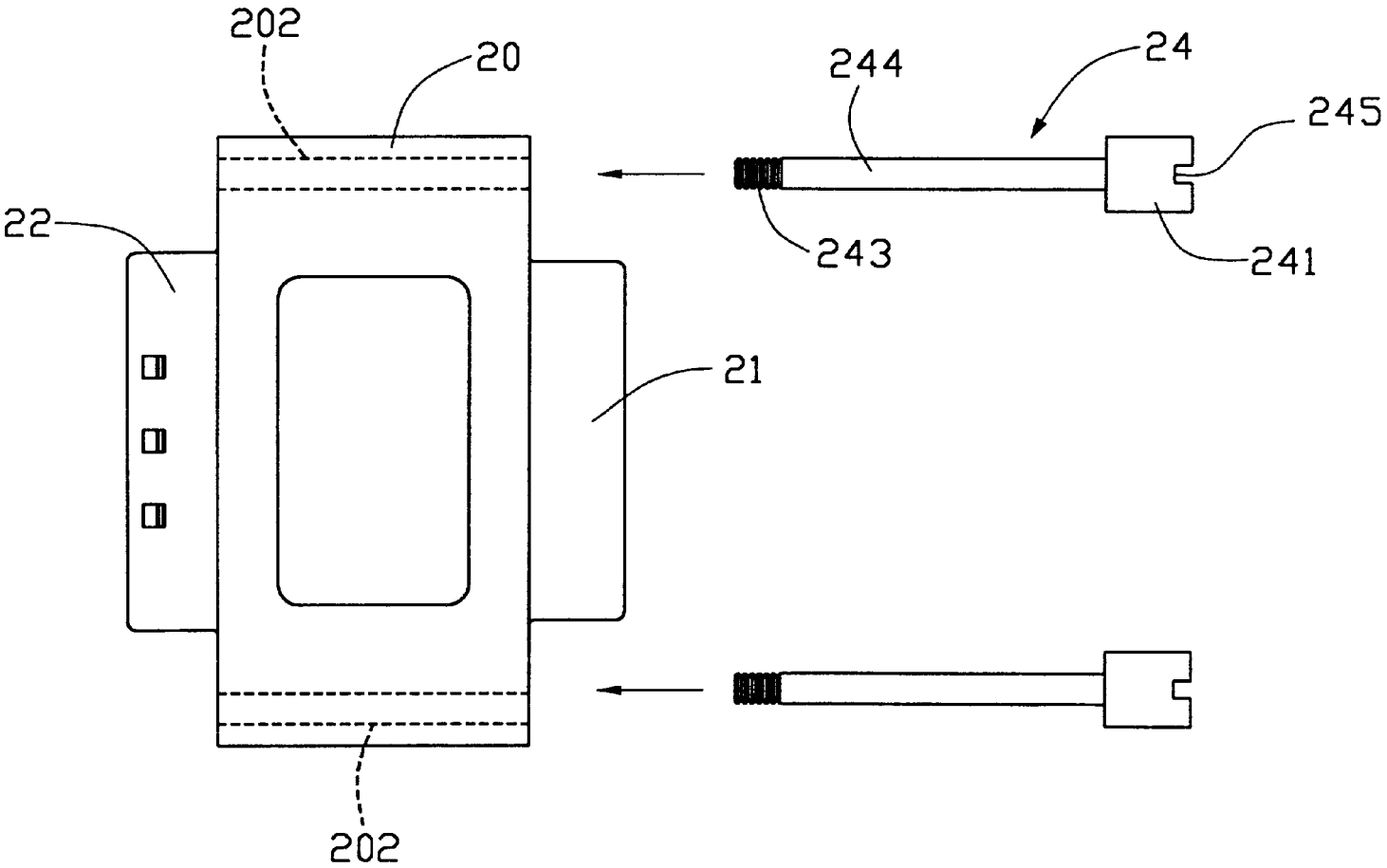
FIG. 3 is a top view of the DVI electrical adapter of FIG. 1 with housing and showing fasteners to be mounted thereto.

Referring to FIGS. 1–3, a DVI electrical adapter 2 in accordance with the present invention comprises a combined digital & analog receptacle connector 21 at a forward end of the adapter 2, a digital-only plug connector 22 at a rearward end of the adapter 2, two printed circuit boards (PCBs) 23 between the receptacle connector 21 and the plug connector 22, an insulative housing 20 insert molded to the adapter 2 between the receptacle connector 21 and the plug connector 22, and a single pair of elongated fasteners 24 projecting all the way through the adapter 2. The combined digital & analog receptacle connector 21 is adapted to connect with a complementary plug connector for connecting to a monitor (not shown). The digital-only plug connector 22 is adapted to connect with a complementary receptacle connector mounted on a host computer (not shown). The insulative housing 20 (best shown in FIG. 3) defines a through hole 202 through either side thereof.

The combined digital & analog receptacle connector 21 comprises an insulative housing 210, a plurality of conductive contacts 213, and a conductive shield 211. The housing 210 defines a plurality of passageways 216 extending therethrough and receiving the contacts 213 therein. Each contact 213 defines a contact section (not shown) at one end thereof extending into the passageways 216 for electrically connecting with terminals of the complementary plug and an engaging section 2130 at an opposite end thereof extending out of the housing 210 for soldering to the PCBs 23. The shield 211 covers a front, top, and bottom of the housing 210 and forms a pair of locking tabs 215 at each opposite end. The locking tabs 215 are bent to engage with corresponding lateral ends of the housing 210, attaching the shield 211 to the housing 210. The housing 210 and the shield 211 respectively define a pair of through holes 214 and a pair of circular openings 217 in opposite sides thereof. The openings 217 align with the through holes 214. Two rivets 212 respectively extend into the through holes 214 and the circular openings 217 and are fixed therein. Each rivet 212 defines a screw hole 2122 therein.

The digital-only plug connector 22 comprises an insulative housing 220, a conductive rear shell 221 and a conductive front shell 222. The housing 220 defines a plurality of plug passageways therethrough (not labeled). The contacts 223 are received in the plug passageways of the housing 220. The contacts 223 have an engaging section 2230 at a forward oriented end thereof. The rear shell 221 forms two locking pieces 225 on two sides thereof for locking with the front shell 222. Both the front hell 222 and the rear shell 221 define a pair of aligning through holes 224, 226 in opposite sides thereof.

Each PCB 23 has electrical components (not shown) and signal traces (not shown) thereon for processing electrical signals transmitted between the two different connectors 21, 22. The engaging section 2130 of the contacts 213 and the engaging sections 2230 of the contacts 223 are respectively soldered onto corresponding PCBs 23 so that the combined digital & analog receptacle connector 21 is electrically connected with the digital-only plug connector 22.

Figure 4:
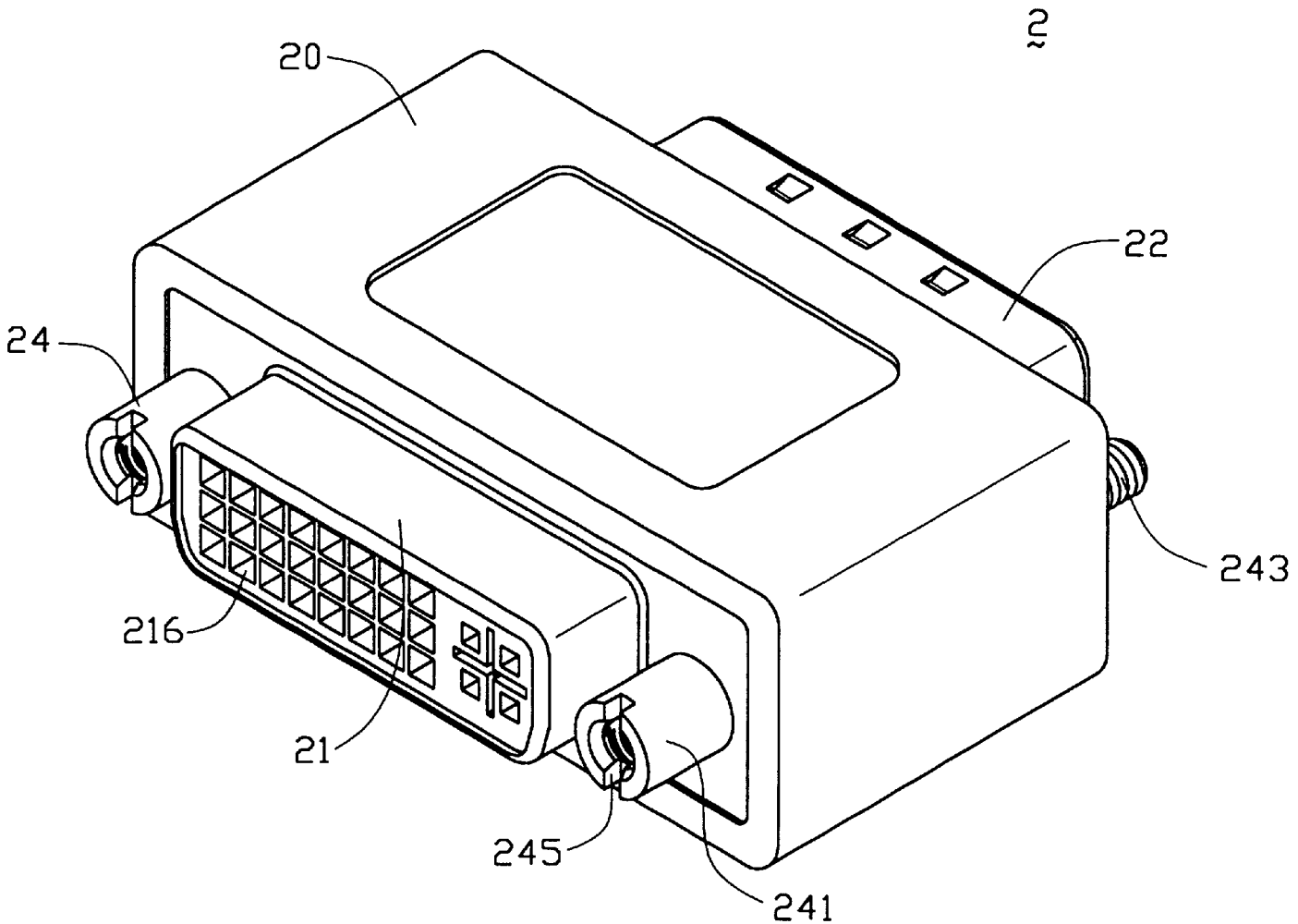
FIG. 4 is an assembled perspective view of the DVI electrical adapter of the present invention.
Figure 5:
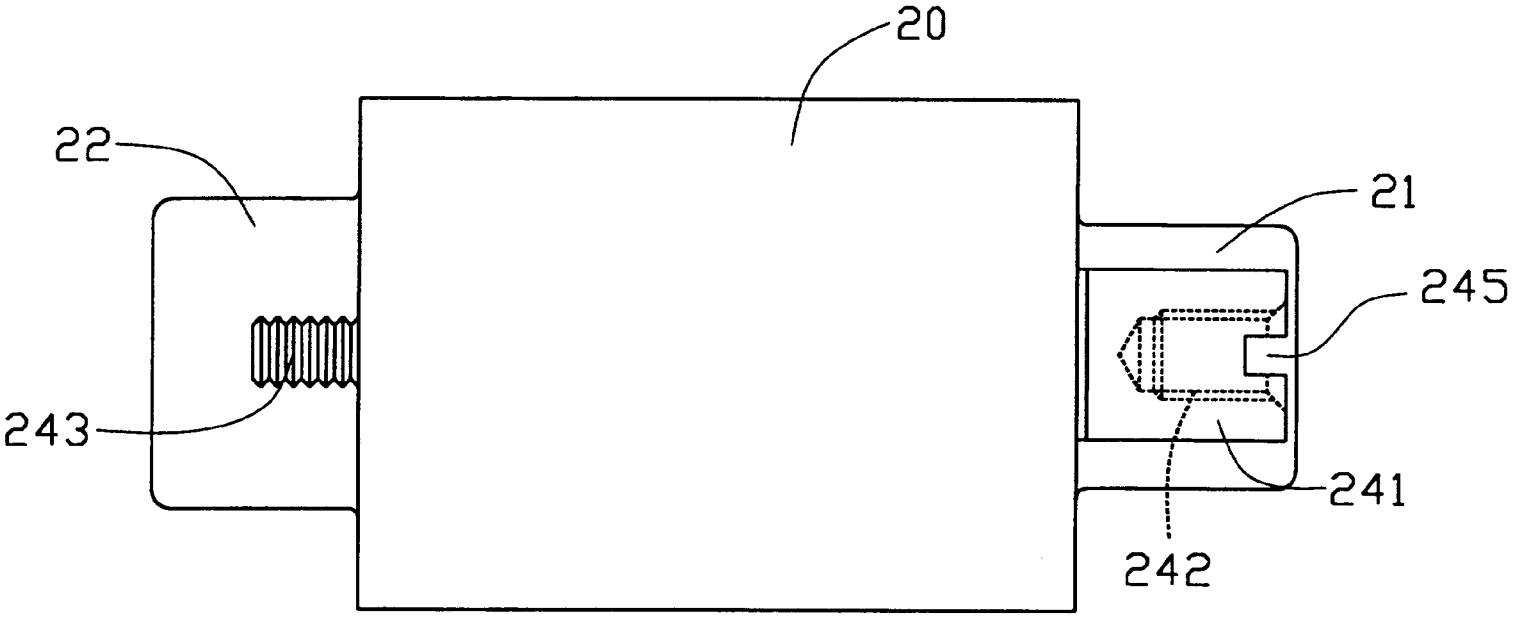
FIG. 5 is a side elevational view of the DVI electrical adapter of FIG. 4.
Figure 6:
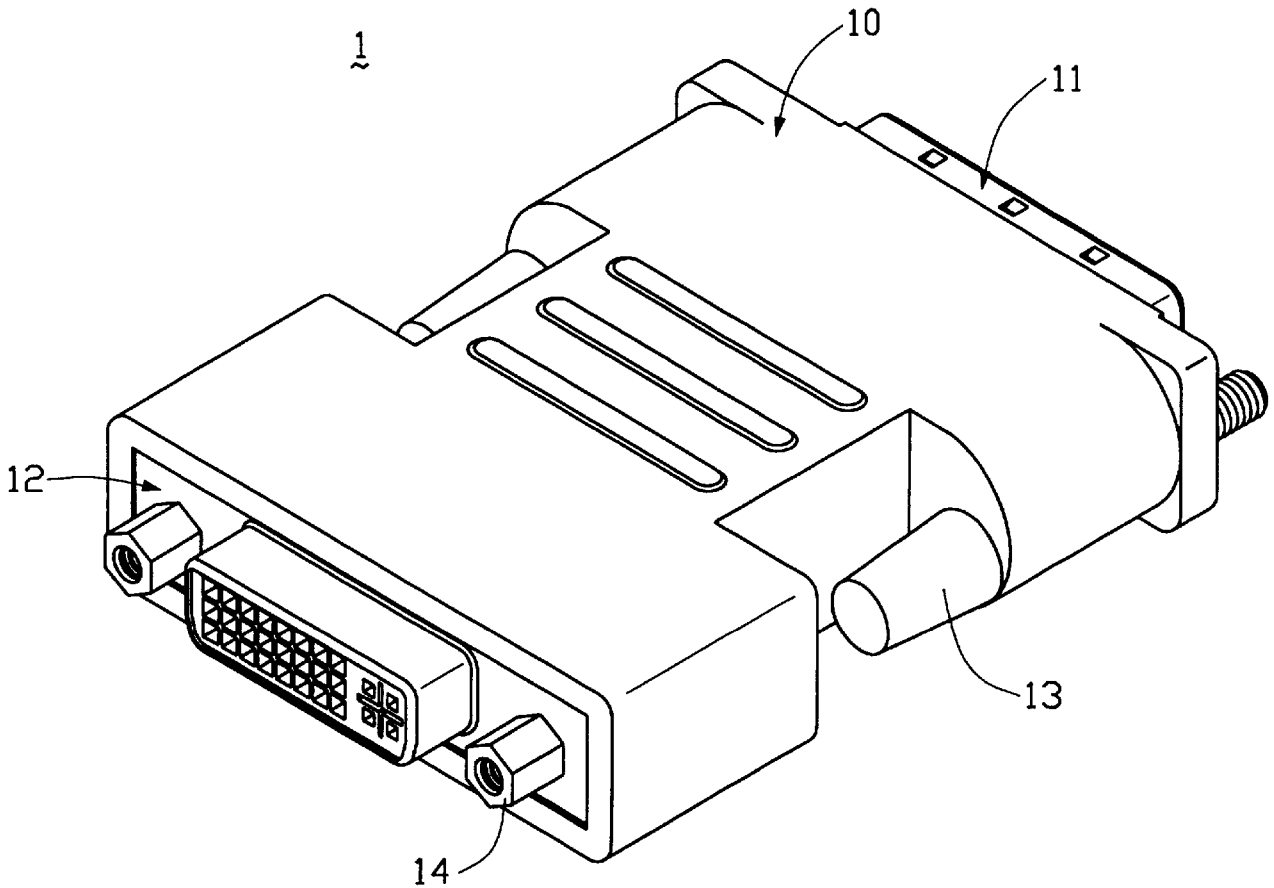
FIG. 6 (PRIOR ART)
FIG. 6 is a perspective view of a conventional DVI electrical adapter.

Referring also to FIG. 4 and FIG. 5, the elongated fasteners 24 each have a first fixing end 241 and a second fixing end 243. The first fixing end 241 is in the form of a nut which has a threaded recess 242 and a slot 245 in front of the threaded recess 242. Each fastener 24 has an elongated post 244 extending rearwards from the first fixing end 241. The elongated post 244 has external threads on a rearmost second fixing end 243.

In assembly, after the receptacle connector and plug connector 21, 22 are soldered to the PCBs 23, and the rivets 212 are fixed to the receptacle connector 21, the subassembly of the plug connector 22, the receptacle connector 21, the PCBs 23, and rivets 212 is put in a mold and the housing 20 is insert molded to the subassembly. The through holes 202 of the housing 20 are formed aligned with the through holes 214 and opening 217 of the receptacle connector 21, the screw holes 2122 of the rivets 212, and the through holes 224, 226 of the plug connector 22. Finally, the elongated fasteners 24 are extended through the through holes 214 and openings 217 of the receptacle connector 21, the screw holes 2122, the through holes 202 of the housing 20, and the through holes 224, 226 of the plug connector 22 to reach a position where the first fixing ends 241 abut a front of the receptacle connector 21 and the second fixing ends 243 extend beyond a rear of the plug connector 22, as is best seen in FIG. 4. The rivets 212 are used to prevent the fasteners 24 from falling out of the adapter 2.

In use, the plug connector 22 is first connected to the complementary receptacle connector (not shown) of the host computer (not shown) and the adapter 2 is secured to the host computer by rotating the first fixing ends 241 of the fasteners 24 until the second fixing ends 243 are firmly engaged with nuts of the complementary receptacle. The slots 245 are devised so that a tool such as a flat screwdriver can be used to tighten the engagement between the second fixing ends 243 and the corresponding nuts. Then, the complementary plug connector of the cable connector assembly of the monitor is connected to the receptacle connector 21, and the screws on said complementary plug connector are threadedly engaged with the threaded recesses 242 of the first fixing ends 241, whereby the plug of the cable connector assembly is secured to the adapter 2. Accordingly, the host computer and the monitor, which have different video interfaces, are electrically connected together.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical adapter, comprising:

a first electrical connector;

a second electrical connector different from the first electrical connector;

an insulative housing connecting both the first electrical connector and the second electrical connector at opposite ends of the housing; and at least an elongated fastener extending through the first connector, the housing and then the second connector, the elongated fastener having a first fixing end and a second fixing end adapted for respectively engaging with fixing elements of a first complementary connector engaging with the first connector and a second complementary connector engaging the second connector, respectively;

wherein the first electrical connector comprises a first housing having a plurality of terminal receiving passageways, a plurality of first contacts received in the terminal receiving passageways and a shield forming two locking tabs on each of two longitudinal sides thereof and which locking tabs lock the shield to the first housing, thereby fixing the shield to the first housing, a rivet with a screw hole axially defined therethrough is fixedly received in the first housing, and the fastener extend through the screw hole;

wherein the second electrical connector comprises a second housing having a plurality of the second contacts received therein, the second housing of the second electrical connector having front and rear shells, the rear shell forming two locking tabs on each of two longitudinal sides thereof which locking tabs lock with the front shell, the two shells of the second electrical connector respectively define at least a through hole in a side thereof through which the elongated fastener extends; and wherein the adapter further comprises a printed circuit board electrically and mechanically connected between the first and the second electrical connectors, the terminals of the two electrical connectors being soldered to the printed circuit board.

2. The electrical adapter as claimed in claim 1, wherein the electrical adapter is a Digital Visual Interface (DVI) electrical adapter.

3. The electrical adapter as claimed in claim 1, wherein the first fixing end of the elongated fastener is in the form of a nut.

4. The electrical adapter as claimed in claim 3, wherein the second fixing end of the elongated fasteners has an external thread.

5. The electrical adapter as claimed in claim 4, wherein the first fixing end and the second fixing end of the elongated fastener are both located outside of the insulative housing.

* * * * *